United States Patent [19]

Berque

[11] 4,455,021

[45] Jun. 19, 1984

[54] METHOD OF STRINGING OR RESTRINGING A TENNIS RACKET

[76] Inventor: David A. Berque, 8 Greenwoods Rd., Old Tappan, N.J. 07675

[21] Appl. No.: 384,091

[22] Filed: Jun. 1, 1982

[51] Int. Cl.[3] ..... A63B 51/14

[52] U.S. Cl. ..... 273/73 A

[58] Field of Search ..... 273/73 A, 73 B; 254/262; 269/904

[56] References Cited

U.S. PATENT DOCUMENTS 2,554,020 5/1951 Fritz ..... 254/262

3,284,050 11/1966 Meyer ..... 273/73 A 4,326,713 4/1982 Balaban ..... 273/73 A

*Primary Examiner*—Richard C. Pinkham

*Assistant Examiner*—Matthew L. Schneider

[57] ABSTRACT

A hand tool for use in stringing or restringing tennis or similar type racquets, consisting of a bracket that clamps to the racquet. The bracket has an extension protruding from it which acts as an anchor for a dual string clamp, allowing the dual string clamp to hold the tension on any newly pulled string in the racquet without using the previously pulled string as an anchor.

1 Claim, 3 Drawing Figures

METHOD OF STRINGING OR RESTRINGING A TENNIS RACKET

BACKGROUND OF THE INVENTION

During the process of stringing or restringing a tennis or similar type racquet, clamps are employed to temporarily hold the tension on a section of string which is being pulled between two holes in opposite sides of the racquet. One type of the said clamp functions by temporarily fixing the said string to an adjacent string which has previously been pulled between a set of holes. This type of clamp is referred to as a dual string clamp.

Dual string clamps are inexpensive and easy to use; however, they have several disadvantages as compared to more expensive clamping systems. For example, when using a dual string clamp, the first two longitudinal strings to be installed in the racquet must be pulled as a pair. If the first string were pulled by itself there would be no adjacent string to clamp it to. Unfortunately, the pulling of these strings as a pair causes a loss in tension on the first longitudinal string. In a similar manner, a loss in tension on the first horizontal string results from pulling the first two horizontal strings as a pair when using a dual string clamp.

A second disadvantage to dual string clamp systems pertains to stringing or restringing oversized racquets. The adjacent strings in oversized racquets are spaced farther apart than are the strings in smaller racquets. It can be difficult, therefore, to position a dual string clamp over two adjacent strings in a oversized racquet.

SUMMARY OF THE INVENTION

This invention provides a small and inexpensive bracket which can be attached to a racquet which is being strung or restrung. From one end of the said bracket protudes an extension having size and shape which allow it to be grasped by a dual string clamp's own clamping mechanism. The dual string clamp simultaneously grasps the newly pulled string as usual. Since the said newly pulled string is now fixed to the dual string clamp, which is fixed to the invention, which in turn is fixed to the racquet frame, the newly pulled string cannot move. Its tension is therefore maintained. Its free end is now pulled between the next set of holes; thus the normal stringing process is continued.

An object of this invention is to allow the first longitudinal and horizontal strings to be pulled alone when using a dual string clamp. This eliminates the tension loss on the first longitudinal and horizontal strings which results from pulling these strings in pairs with the second longitudinal and second horizontal strings respectively.

A second object of the invention is to eliminate the difficulty encountered when using a dual string clamp to string or restring an oversized racquet.

DRAWINGS

DESCRIPTION OF THE PREFERRED EMBODIMENT

Figure 1:
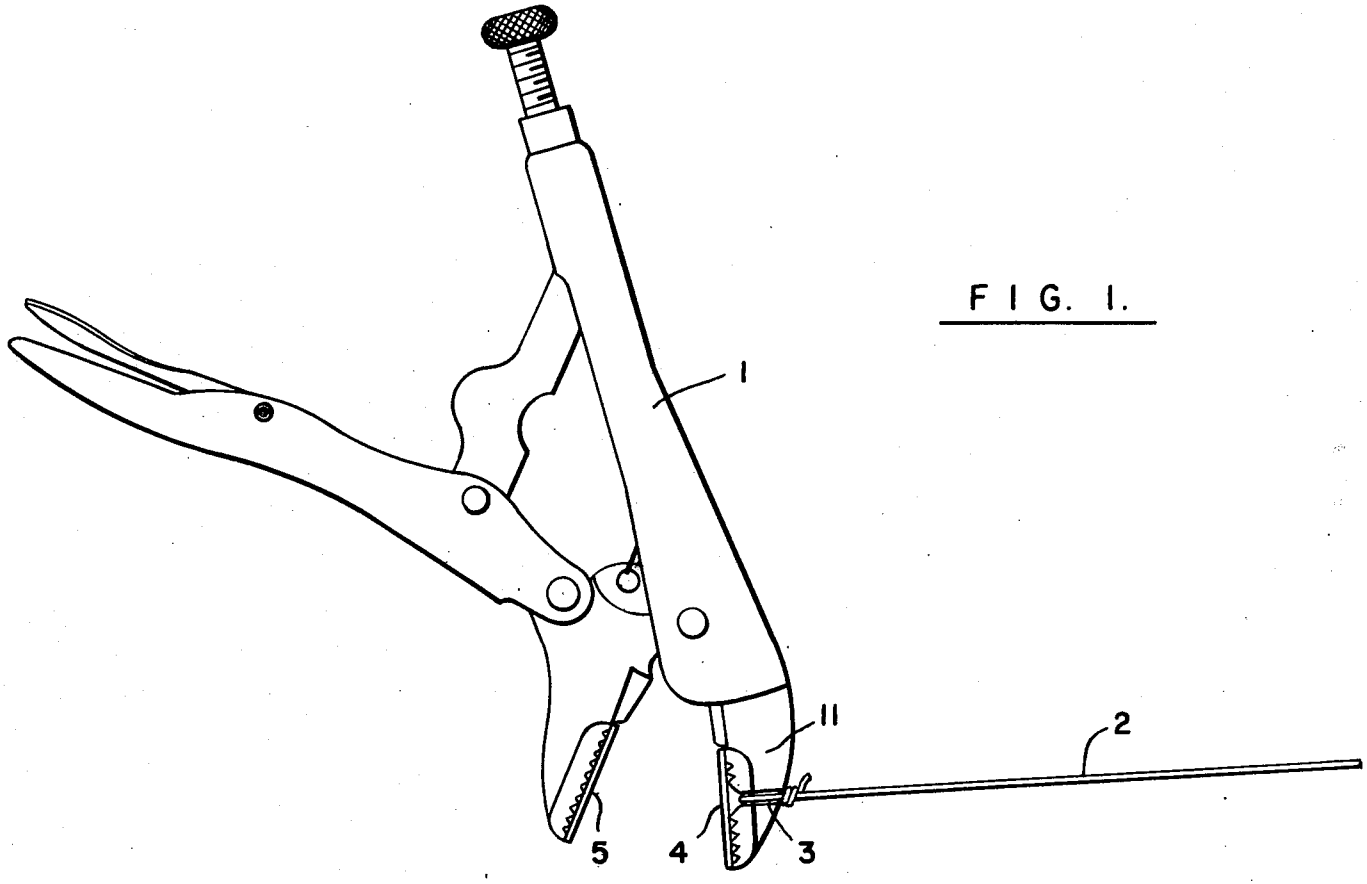
FIG. 1 is a side view of the invention in its entirety.

Referring to FIG. 1, the invention in its best form consists of a modified pair of locking pliers 1 connected to an extension 2. The invention in this form is constructed by filing or sawing a circular groove 3 in the jaw 11 of the locking pliers 1. The extension 2 is made of flexible wire having a diameter equal to that of average size tennis string. The said extension 2 is wrapped around the groove 3 and then wrapped around itself several times. This construction allows the said extension 2 to swivel from side to side with respect to the said locking pliers 1 but, restricts all front to back and top to bottom movement by the said extension 2. In order to protect the surface of the racquet, the inside edges of the locking plier's jaws are covered with rubber pads 4 & 5 which may be glued in place.

Figure 2:
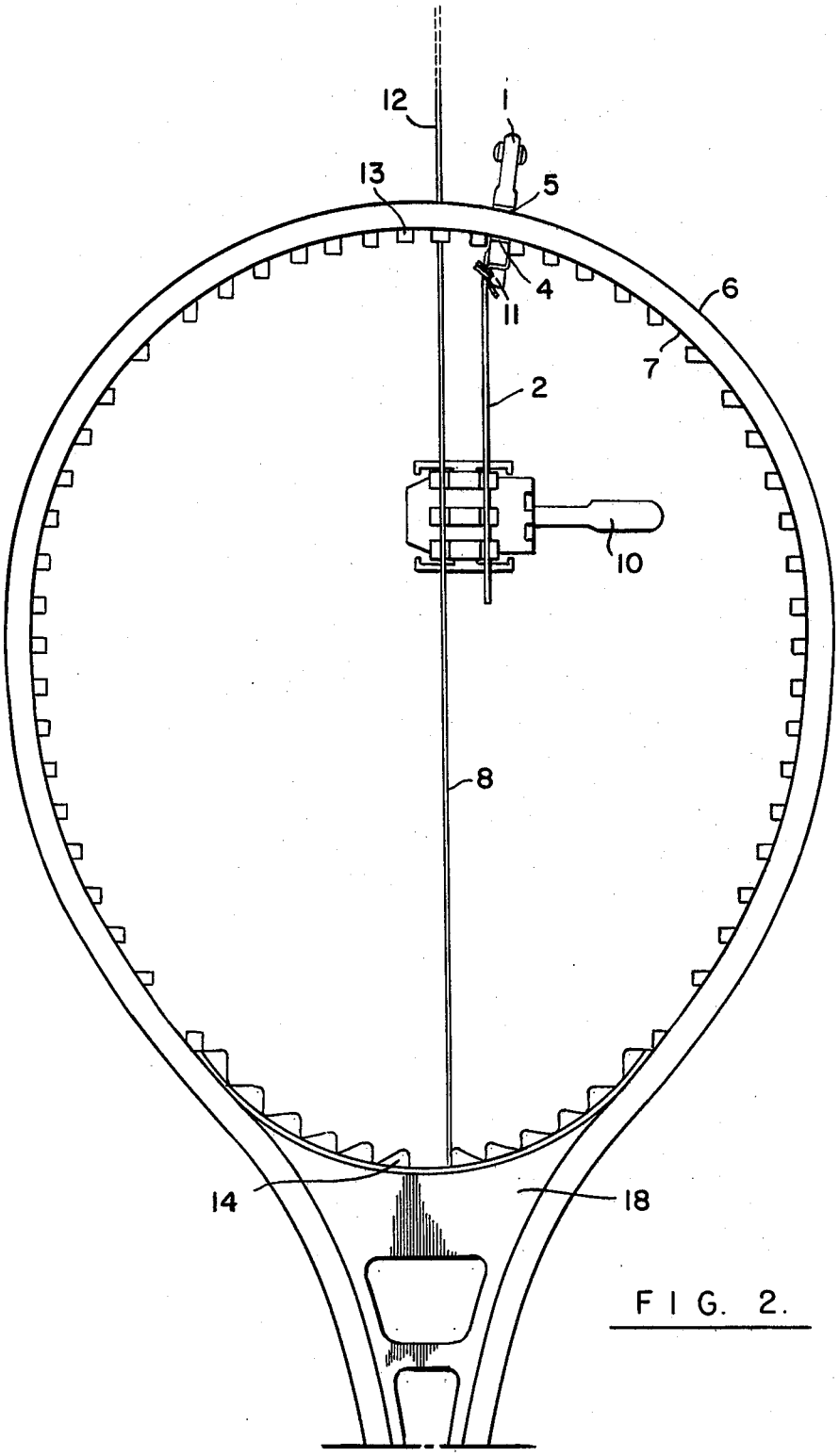
FIG. 2 is a top view of the invention being used with a dual string clamp to hold tension on the first longitudinal string of a racquet which is being strung.

Referring now to FIG. 2, in order to use the invention to hold tension on the first longitudinal string 8, the said first longitudinal string 8 is inserted between the set of holes located immediately to one side of the racquets center. The said first longitudinal string 8 is secured at one end as is usual. (The method for securing the said first longitudinal string 8 is not shown in FIG. 2 because it is standard procedure.) The locking pliers 1 are clamped to the racquet 18 so that the said locking pliers 1 lie next to the first longitudinal string 8 in such a way that the pad 5 is in contact with the outside edge 6 of the racquet 18 and the pad 4 is in contact with the inside edge 7 of the racquet 18. Furthermore, the extension 2 shall lie parallel to the first longitudinal string 8 such that the distance between the said extension 2 and the said first longitudinal string 8 is aproximately equal to the average distance between strings on a tennis racquet. In addition, the said locking pliers 1 shall lie on the opposite side of the first longitudinal string 8 from which the second longitudinal string will be placed. For example, if the second longitudinal string will be placed to the left of the first longitudinal string 8 then, the invention should be placed to the right of the said first longitudinal string 8. This is the positioning illustrated in FIG. 2. Next, the free end 12 of the first longitudinal string 8 is pulled in the usual manner, and a dual string clamp 10 is used to fix the first longitudinal string 8 to the extension 2 thereby maintaining the tension on the first longitudinal string 8. FIG. 2 illustrates the set-up described above. (Note that for maximum efficiency, the dual string clamp 10 should be placed as close to the junction of the extension 2 with the locking pliers 1 as possible. For the purpose of clarity in both FIG. 2 and FIG. 3, the distance between the dual string clamp and the junction of the extension 2 with the locking pliers 1 was exagerated.) At this time, the free end 12 of the first longitudinal string 8 can be inserted through the next set of holes 13 & !4, pulled, and clamped, using the dual string clamp, to the first longitudinal string 8 as is standard procedure.

Figure 3:
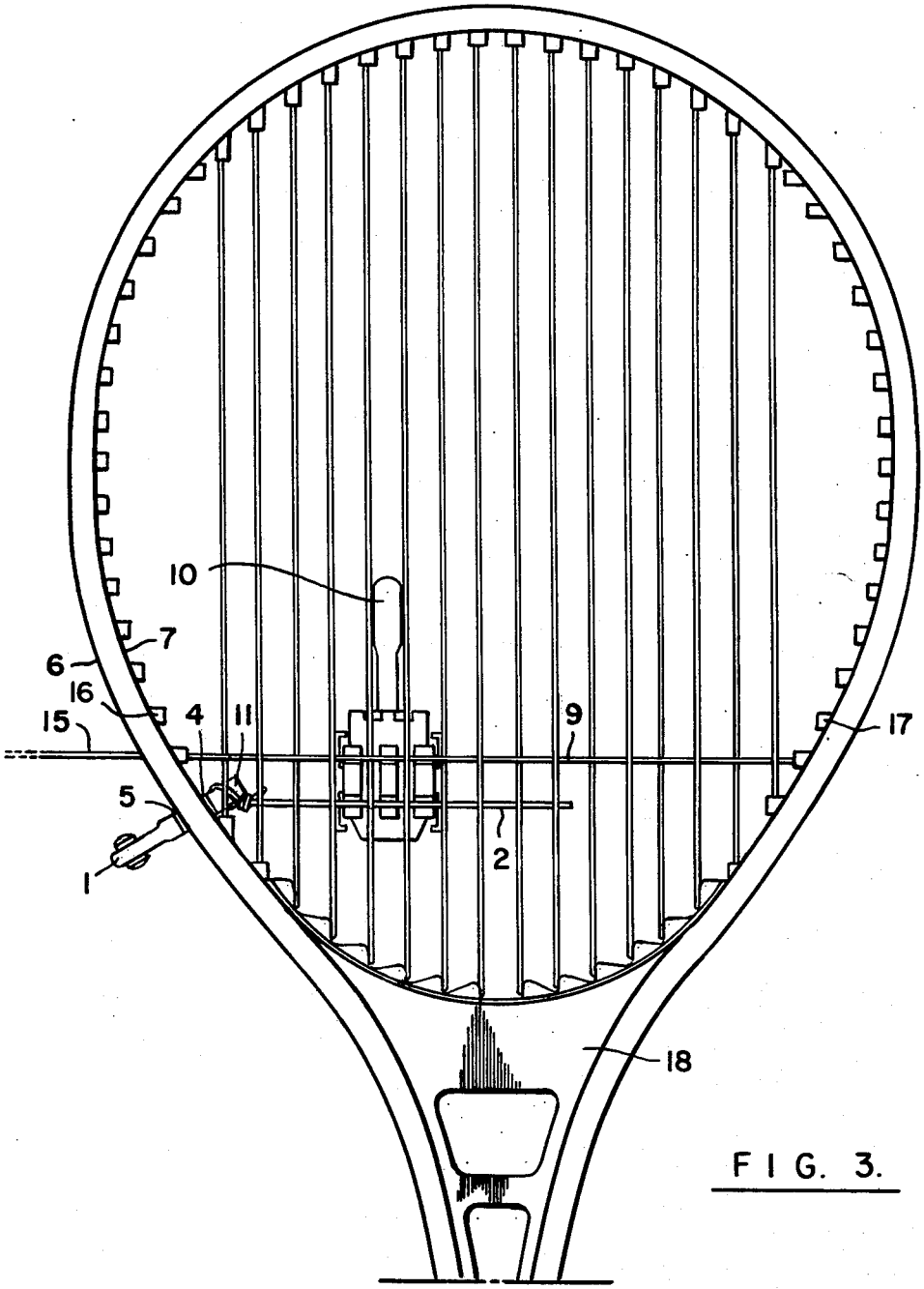
FIG. 3 is a top view of the invention being used with a dual string clamp to hold tension on the first horizontal string of a racquet which is being strung.

FIG. 3 illustrates the invention being used to hold tension on the first horizontal string 9. The locking pliers 1 are clamped to the racquet frame 18 so that the said locking pliers 1 lie next to the first horizontal string 9 in such a way that the pad 5 is in contact with the outside edge 6 of the racquet 18 and the pad 4 is in contact with the inside edge 7 of the racquet 18. Furthermore, the extension 2 shall lie parallel to the first horizontal string 9 such that the distance between the said first horizontal string 9 and the said extension 2 is aproximately equal to the distance between strings on a standard tennis racquet. In addition, the said locking pliers 1 shall lie on the opposite side of the first horizontal string 9 from which the second horizontal string will be placed. Finally, it must be noted that the extension 2 may lie either above or below the longitudinal strings which by convention are installed in the racquet frame before the horizontal strings. In FIG. 3, the said extension 2 is depicted as being below the longitudinal strings. Next, the free end 15 of the first horizontal string 9 is pulled in the usual manner, and a dual string clamp 10 is used to fix the first horizontal string 9 to the said extension 2 thereby maintaining tension on the first horizontal string 9. FIG. 3 illustrates the set-up described above. At this time, the free end 15 of the first horizontal string 9 is inserted in the next set of holes 16 & 17, pulled, and clamped using the dual string clamp 10 to the first horizontal string 9 thus the normal stringing process is continued.

To use the invention to install any other string on the racquet (especially useful when stringing an oversized racquet) the directions in one of the two preceeding paragraphs should be followed. The former paragraph for any longitudinal string and the latter paragraph for any horizontal string. The locking pliers 1 being placed next to the string which is being installed instead of next to the first longitudinal or horizontal string as described in the preceeding paragraphs.

While this is a description of the invention in its best form, modifications may be made which change neither the spirit nor scope of the invention. Possible modifications include, but are not limited to, changing the material from which the extension 2 is constructed from and/or substituting the locking pliers 1 with a different system for holding the said extension 2 to the racquet frame 18.

I claim:

1. A method of stringing or restringing a tennis racquet comprising the steps of: employing a bracket, said bracket having an elongated extension extending therefrom; clamping said bracket to said racquet such that the extension lies parallel and proximate to a string being strung; applying a clamp means simultaneously to said extension and to said string to be strung so as to temporarily retain said string against movement relative to said extension such that a predetermined tension can be maintained on said string.

* * * * *